United States Patent [19]

Monsheimer et al.

[11] 4,105,402

[45] Aug. 8, 1978

[54] TREATMENT OF SULFIDE-LIMED PELTS IN ACID BATHS

[75] Inventors: Rolf Monsheimer, Darmstadt-Eberstadt; Ernst Pfleiderer, Darmstadt-Arheilgen, both of Fed. Rep. of Germany

[73] Assignee: Rohm GmbH, Darmstadt, Fed. Rep. of Germany

[21] Appl. No.: 793,407

[22] Filed: May 3, 1977

[30] Foreign Application Priority Data

May 15, 1976 [DE] Fed. Rep. of Germany ..... 2621697

[51] Int. Cl.[2] ..... C14C 1/00; C14C 1/08

[52] U.S. Cl. ..... 8/94.17; 8/94.1 R; 8/94.18; 8/94.25

[58] Field of Search ..... 8/94.17, 94.25, 94.18

[56] References Cited

PUBLICATIONS

Strack, W., Das Leder, 1967, 18, pp. 233–235.

Zehender, F., "Oxidation of Sulfide-Sulfur with Manganese Salt", Chem. Abs., 1970, 73 (No. 8).

*Primary Examiner*—A. Lionel Clingman

*Attorney, Agent, or Firm*—Curtis, Morris & Safford

[57] ABSTRACT

A method of treating sulfide-limed pelts in improved acid treating baths for purposes of de-liming, bating, pickling, or pre-tanning is disclosed. The improved baths contain water-soluble salts of manganese, cobalt, nickel, titanium, or zirconium, which salts discourage hydrogen sulfide formation during the acid treatment.

9 Claims, No Drawings

TREATMENT OF SULFIDE-LIMED PELTS IN ACID BATHS

The present invention relates to a method for the treatment or continued treatment of sulfide-limed pelts in acid treating baths, for example in deliming, in bating, in pickling, or in the pretreatment for a synthetic-vegetable rapid-tanning.

At the conclusion of liming with sulfides in a strongly alkaline medium, the principal portion of the sulfide employed is drained off with the liming liquid. The residues of the sulfide-containing liming liquid adhering on the skins are removed by washing with water. Nevertheless, during subsequent treatment steps in the acid region, considerable amounts of hydrogen sulfide originating from the sulfide residues in the unhaired hide material are liberated. W. Strack, of the Professional Society of the Leather Industry has written, in the periodical "Das Leder" 18, 233–235 (1967), of the dangers to tannery personnel which arise from the hydrogen sulfide which is released from acid treating baths. The hydrogen sulfide for the most part first remains dissolved in the acid treating baths or is absorbed on sludge particles: This can lead to the liberation of considerable amounts of gaseous hydrogen sulfide in the waste water system.

The liberation of hydrogen sulfide from sludge deposits in the waste water system of tanneries has in the past repeatedly led to fatal accidents. To avoid these accidents it has been proposed to add manganese salts to the waste water, which salts will catalyze the oxidation, by oxygen, of hydrogen sulfide to sulfate. However, this leads to only a partial solution of the problem. The acid treating baths continuously give off hydrogen sulfide to the surrounding atmosphere. To be sure, by evacuation of the air from the treatment vessel and from the work rooms, life-endangering concentrations of hydrogen sulfide in the air can be avoided. Nevertheless, the recommended maximum permissible concentration of $H_2S$ in the air of the work area is considerably exceeded.

Thus, the problem was presented of rendering the hydrogen sulfide liberated from sulfide-limed pelts innocuous, not merely on disposal of the acid treating baths in the waste water system, but already during the further processing of the sulfide-limed pelts during deliming, bating, pickling, and tanning. A solution of this problem has been found by adding a water-soluble metallic salt of manganese, cobalt, nickel, titanium, or zirconium to the acid treating bath and bringing the treating bath into contact with oxygen.

Suitable metal salts, which can be used alone or in combination, are, above all, the water-soluble chlorides and sulfates of the aforementioned metals, e.g. manganese-II-chloride or -sulfate, cobalt-II-chloride, nickel chloride or -sulfate, titanyl sulfate or zirconyl sulfate. The metal salts are suitably added in an amount of 50 to 5000 parts per million parts of the treating bath. The water-soluble salts of manganese-II have proved to be particularly effective and are therefore preferably used.

The oxygen serving as the oxidation agent is as a rule atmospheric oxygen. When working in a drum, the amount of air enclosed therein generally is insufficient to oxidize the hydrogen sulfide to the desired degree.

Thus, it is suitable to introduce air through the hollow axis. It is understandable that the oxidation of the sulfide or of the hydrogen sulfide takes place the more rapidly and more completely the longer and more vigorously the pelts are agitated. When working in an open paddle, particularly good access to air is afforded. Nevertheless, undersirably large amounts of hydrogen sulfide are given off into the air before complete oxidation.

It is surprising that the oxidation of sulfide or of hydrogen sulfide occurs despite the presence of the chemicals contained in the acid treatment baths and that the presence of the pelts permits oxidation. In particular, it is believed to be surprising that no disadvantageous changes in the hide material have been determined. In certain cases, however, a sensitivity of many bating enzymes to the metal salts was observed. Manganese salts produced no such disturbances and are preferred for this reason.

For working in the beamhouse and tannery, it is suitable to add an amount of the metal salt sufficient for the agents employed in the acid treatment stages. In most cases it is already sufficient to add the aforementioned metal salts during de-liming in order also significantly to reduce the development of hydrogen sulfide gas from sulfide-containing pelts in the working stages after deliming. After use of the metal salts in de-liming, only such amounts of hydrogen sulfide were detected in the following bating as were considerably under the danger zone of 1,000 ppm and which were in the neighborhood of the recommended permissible $H_2S$ concentrations for the work area.

A content of the metal salts from 2 to 20 percent by weight in the de-liming, bating, or tanning agents, which otherwise respectively comprise the components conventionally found therein, is as a rule sufficient. A de-liming agent which has a composition according to the present invention can, for example, comprise from 2 to 20 percent of manganese-II-sulfate or -chloride and, for the remaining portion, comprise conventional deliming chemicals such as ammonium sulfate, sodium hydrogen sulfate, phosphoric acid salts or organic acids such as citric acid, oxalic acid, sulfophthalic acid, adipic acid, succinic acid, glycolic acid, acetic acid, or formic acid. In the same manner, the bating agents according to the present invention, in addition to the bating enzymes and conventional bating agent components such as ammonium sulfate, sawdust, inert inorganic or organic carrier substances, ammonium chloride or neutral salts, may contain from 2 to 20 percent by weight of manganese-II-sulfate or -chloride.

The compositions of conventional de-liming, bating, pickling, and pre-tanning agents are well known in the art and are summarized in the following literature survey given in Table I. The literature sources referred to in the table are Stather, "Gerbereichemie und Gerbereitechnologie," Berlin (1967); O'Flaherty, "The Chemistry and Technology of Leather," Reinhold Publishing Corporation, New York (1956); Grassmann, "Handbuch der Gerbereichemie und Lederfabrikation," Volume 1, part 2 ("Die Wasserwerkstatt"), Vienna (1938); Herfeld, "Grundlagen der Lederherstellung, " Leipzig (1950); and Moellering, "Verfahren der Gerbereichemie," Stuttgart (1954), all of which are incorporated herein by reference.

Table I

| | Literature Survey | | | | | |
|---|---|---|---|---|---|---|
| | Stather Pages | O'Flaherty Pages | Grassmann Pages | Herfeld Pages | Moellering Pages | |
| De-liming Agents | 212–215 | 335–339 | 180–193 | 125–131 | 52–62 | Hydrochloric acid<br>Sulfuric acid<br>Organic acids (formic, acetic, lactic, butyric)<br>Boric acid, sodium bisulfite<br>Ammonium salts |
| Bating Agents | 221–222 | 339–341 | 224–230 | 140–142 | 62–83 | Pancreatic enzymes together with sawdust<br>Ammonium salts and sodium chloride<br>Papain, mold fungus and bacterial proteases with similar additives |
| Pickling Agents | 423–425 | 430–433 | 282–298 | (see de-liming) | (see de-liming) | Mineral acids (HCl, $H_2SO_4$) and sodium chloride<br>Formic, lactic, or acetic acid and sodium chloride<br>Sulfosalicylic acid Sulfoanthranilic acid<br>Sulfophthalic acid |
| Pre-Tanning Agents | 315–317 | | | | | Aluminum sulfate, polyphosphates<br>Chromium compounds<br>Phosphates<br>Formaldehyde<br>Quinone<br>Amine-formaldehyde resins<br>Lignin extracts |

The heavier are the hides to be treated, the slower the sulfide diffuses from the interior of the hides into the treating bath. Thus, it can be necessary to employ metal salts according to the present invention in all acid treatment stages carried out after sulfide-liming, i.e. in all treatment baths having an initial pH value between 2 and 7.

A better understanding of the present invention and of its many advantages will be had from the following specific examples, given by way of illustration. More in particular, it will be evident from the following examples to what degree the development of hydrogen sulfide is decreased by the process of the present invention. The percentage values in all of the examples pertain to the weight of the pelts.

EXAMPLE 1

A De-liming Which Decreases Hydrogen Sulfide Gas 500 kg of calf pelts are treated in a paddle, after fleshing, first with 200 percent of water at 30° C. for 30 minutes. Thereafter, the bath is discarded and de-liming and bating follow.

De-liming

200% of water, 30° C
1.0% of ammonium sulfate
1.0% of sulfophthalic acid
0.1% of manganese sulfate
Agitation for 20 minutes at pH = 8.5.

Bating 0.02% of trypsin having 25,000 LVE
0.4% of ammonium sulfate
0.5% of glycolic acid Agitation for 40 minutes. The pH value is 5.5 at the beginning of bating and 8.5 at the end thereof.

In comparision with pelts which are not treated with manganese chloride, the formation of hydrogen sulfide gas is decreased by a factor of three from about 300 ppm to about 100 ppm. No disadvantageous influences, such as spot formation and the like, can be detected on the hides or on colored leather when compared to hides or leather which have not been treated with manganese salts.

EXAMPLE 2

A Bating of Bull Pelts, in a Drum, Which Reduces Hydrogen Sulfide Gas 500 kg of bull pelts, after fleshing and splitting, were agitated in a drum for 10 minutes at six revolutions per minute (rpm) with 200 percent of water at 36° C. Subsequently, the bath was discarded.

While blowing air through, de-liming and bating followed with:

100% of water, 36° C.
2.0% of ammonium sulfate
0.5% of adipic acid
0.136% of alkaline bacterial proteinase having 77,000 LVE
0.05% of manganese chloride The pH value of the bath was 5.0 at the beginning and 8.0 after 30 minutes. The treatment was concluded after 50 minutes.

Formation of hydrogen sulfide gas in the combined de-liming and bating is reduced by a factor of three, namely from about 900 ppm to about 300 ppm. Side effects which influence quality, such as spot formation, were not observed.

EXAMPLE 3

A Reduction of Hydrogen Sulfide Gas in a Pretreatment for a Synthetic-vegetable Rapid-tanning 500 kg of cow pelts were first washed in a drum, after fleshing, with 150 percent of water at 20° C. for 20 minutes with agitation at four rpm. Thereafter, the bath was discarded.

While blowing air through, pre-treatment of the hides was carried out with:

2.5% of ammonium sulfate
1.5% of sodium bisulfate
0.1% of zirconyl sulfate
3.0% of formic acid, 42%

The formic acid was gradually added through the hollow axis. The duration of the agitation was three to four hours. The pH value of the residual bath was 3.2 to 3.5.

A development of $H_2S$ of 120 ppm was measured. In comparison therewith, the formation of gaseous hydrogen sulfide is higher by a factor of five when metal salts are not employed in the pre-treatment, namely 600 ppm. No change in the leather color could be determined.

EXAMPLE 4

A Reduction of Hydrogen Sulfide Gas During Pickling 500 kg of conventionally de-limed and bated goat pelts are pickled in a mixer with:

80% of water, 20° C
10% of sodium chloride
0.1% of titanyl sulfate

The pelts are moved in the mixer for 10 minutes, after which 0.4% of technical grade hydrochloric acid (diluted 1:10) is added and agitation is continued for a further 15 minutes.

After the addition of 0.8% of formic acid [85% technical grade (diluted 1:10)], the hides are agitated for a further 2 hours.

The pH value at the end of the pickle is 3.5. The cross section of the unhaired hides is uniform and shows an olive-yellow color on testing with bromcresol green solution.

The development of hydrogen sulfide gas is reduced by a factor of three. Values of 45 to 55 ppm were measured.

EXAMPLE 5

Reducing Hydrogen Sulfide Gas During De-liming 500 kg of sheep pelts were washed after fleshing in a paddle with 200% of water at 30° C for 30 minutes. The bath was then discarded. De-liming followed with:

250% of water, 30° C
1% of ammonium sulfate
1% of citric acid
0.1% of cobalt chloride.

The pelts were agitated for 30 minutes at a pH of 7.5.

Pickling followed in the same bath. In comparison with pelts not treated with cobalt chloride, the formation of hydrogen sulfide gas is reduced by a factor of three when operating according to this Example.

EXAMPLE 6

Bating of Pig Skins in a Drum with a Decrease of Hydrogen Sulfide 200 kg of pig pelts are moved in a drum at 6 rpm with 200% of water at 35° C for 20 minutes after fleshing and splitting. Subsequently, the bath was discarded. De-liming and bating followed, while blowing air through, using:

120% of water, 36° C
1% of ammonium sulfate
1% of lactic acid
0.7% of alkaline bacterial proteinase having 77,000 LVE
0.02% of trypsin having 25,000 LVE
0.15% of nickel chloride.

The pH value of the bath was 4.5 at the beginning and 7.5 after one hour. The treatment was concluded after 90 minutes. In comparison with baths to which catalysts had not been added, the formation of hydrogen sulfide gas was reduced by a factor of four. Whereas value of 1,200 ppm were measured in the absence of a catalyst, the measurement in the presence of a catalyst addition was only 300 ppm.

What is claimed is:

1. In the method of treating sulfide-limed pelts with an acid treating bath, the improvement werein said treating bath contains a water-soluble salt of manganese, cobalt, nickel, titanium, or zirconium and wherein said treating bath is brought into contact with oxygen.

2. A method as in claim 1 wherein said treatment with an acid treating bath is a de-liming, bating, pickling, or pre-tanning treatment.

3. A method as in claim 1 wherein the pH of the acid treating bath is between 2 and 7.

4. A method as in claim 1 wherein said water-soluble salt is present in said treating bath in an amount between 50 and 5000 parts per million.

5. A method as in claim 1 wherein said water-soluble salt is a manganese-II salt.

6. A de-liming, bating, pickling or pre-tanning agent of conventional composition additionally comprising a water soluble salt of manganese, cobalt, nickel, titanium, or zirconium.

7. An agent as in claim 6 which comprises from 2 to 20 percent by weight of said water-soluble salt.

8. A de-liming agent comprising conventional de-liming chemicals and, additionally, 2 to 20 percent by weight of manganese-II sulfate or manganese-II-chloride.

9. A bating agent comprising conventional bating enzymes and bating auxiliaries and, additionally, 2 to 20 percent by weight of manganese-II-sulfate or manganese-II-chloride.

* * * * *